US007100381B2

(12) United States Patent
Hale et al.

(10) Patent No.: US 7,100,381 B2
(45) Date of Patent: Sep. 5, 2006

(54) SLOT JET COOLER AND METHOD OF COOLING

(75) Inventors: Charles A. Hale, Tucson, AZ (US); Chad E. Boyack, Tucson, AZ (US); Thomas H. Lind, Tucson, AZ (US); Kevin R. Hopkins, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 281 days.

(21) Appl. No.: 10/677,714

(22) Filed: Oct. 2, 2003

(65) Prior Publication Data

US 2005/0072177 A1 Apr. 7, 2005

(51) Int. Cl.
*F28C 1/00* (2006.01)

(52) U.S. Cl. ..... 62/121; 62/304

(58) Field of Classification Search ..... 62/121, 62/304, 506

See application file for complete search history.

(56) References Cited

U.S. PATENT DOCUMENTS 5,391,052 A * 2/1995 Correia et al. ..... 415/115

* cited by examiner

*Primary Examiner*—Melvin Jones
(74) *Attorney, Agent, or Firm*—Renner, Otto, Boisselle & Sklar, LLP

(57) ABSTRACT

A cooling device for cooling a cooled surface includes a manifold having a number of inlet slots for directing fluid into an enclosed volume or chamber, toward the cooled surface. The manifold has a number of exit ports for receiving the fluid from the enclosed volume or chamber after it has impinged upon the cooled surface. The inlet slots and exit ports may be rectangular, or may be otherwise elongated, so as to provide substantially spatially uniform heat removal from the cooled surface. The cooling device may be used for a wide variety of applications, for example for cooling small devices such as integrated circuits or other devices involving electronics.

23 Claims, 3 Drawing Sheets

SLOT JET COOLER AND METHOD OF COOLING

TECHNICAL FIELD

The invention relates to cooling devices and methods, and in particular to cooling devices and methods utilizing a coolant or cooling fluid.

BACKGROUND OF THE RELATED ART

Device thermal management is increasingly associated with large distributed heat loads, very high localized heat fluxes, stringent temperature control requirements, and/or difficult-to-meet platform compatibility requirements. Prior approaches to solving these problems include cooling schemes such as pool boiling, detachable heat sinks, channel flow boiling, micro-channel and mini-channel heat sinks, jet impingement, and spray cooling. However, none of these prior approaches has proved uniformly successful in device thermal management. Accordingly, there is a need for thermal management or cooling devices that provide improved performance.

SUMMARY OF THE INVENTION

According to one aspect of the invention, a cooling device for cooling a cooled surface includes: a manifold; and one or more side walls. The manifold, the side wall(s), and the cooled surface together define an enclosed volume. The manifold and the cooled surface are on opposite sides of the enclosed volume. The manifold has plural inlet slots therein for directing fluid at the cooled surface. The inlet slots are substantially parallel to each other.

According to another aspect of the invention, a method of cooling a cooled surface includes the steps of directing a cooling fluid into an enclosed volume through a plurality of substantially-parallel inlet slots toward a major surface of the cooled surface; transferring heat from the cooled surface to the cooling fluid; and removing the cooling fluid from the enclosed volume through exit ports, wherein adjacent pairs of the inlet slots have respective substantially-parallel exit ports therebetween.

According to still another aspect of the invention, a method of designing a slot jet cooling device includes the steps of: selecting a cooling fluid; selecting a desired operating regime; performing a parametric study calculating parameters for a variety of geometries; and selecting a cooling device design based on results of the parametric study.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

A cooling device for cooling a cooled surface includes a manifold having a number of inlet slots for directing fluid into an enclosed volume or chamber, toward the cooled surface. The manifold has a number of exit ports for receiving the fluid from the enclosed volume or chamber after it has impinged upon the cooled surface. The inlet slots and exit ports may be rectangular, or may be otherwise elongated, so as to provide substantially spatially uniform heat removal from the cooled surface. The cooling device may be used for a wide variety of applications, for example for cooling small devices such as integrated circuits or other devices involving electronics.

Figure 1:
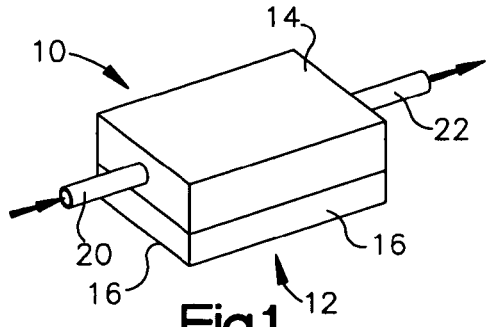
FIG. 1 is an isometric drawing of a slot jet cooling device in accordance with the present invention.

Referring initially to FIG. 1, a cooling device 10 for cooling a heat source or surface to be cooled 12 includes a manifold 14, and one or more side walls 16. The heat source 12 may be any of a variety of heat-generating devices or devices to be cooled, or may be a device or surface that is thermally coupled to a heat-generating device or device to be cooled. The heat source 12, the manifold 14, and the side walls 16 all serve to define an enclosed volume or chamber in the interior of the cooling device 10. The manifold receives a cooling fluid from a fluid inlet 20. The fluid is then directed within the manifold 14 into the enclosed volume, toward the heat source 12. The fluid impinges upon the surface of the heat source 12, removing heat from the heat source 12. Heated fluid is removed from the enclosed volume, and is output from the manifold 14 via a fluid outlet 22. The cooling device 10 may be hooked up to a circuit for recirculating the cooling fluid, for example, by use of a suitable pump.

Figure 2:
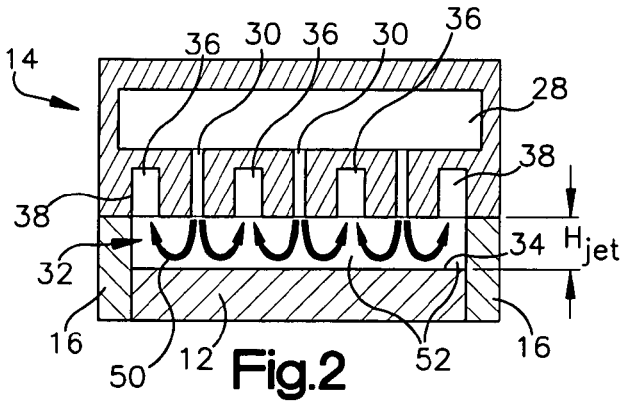
FIG. 2 is a side sectional view of the cooling device of FIG. 1.
Figure 3:
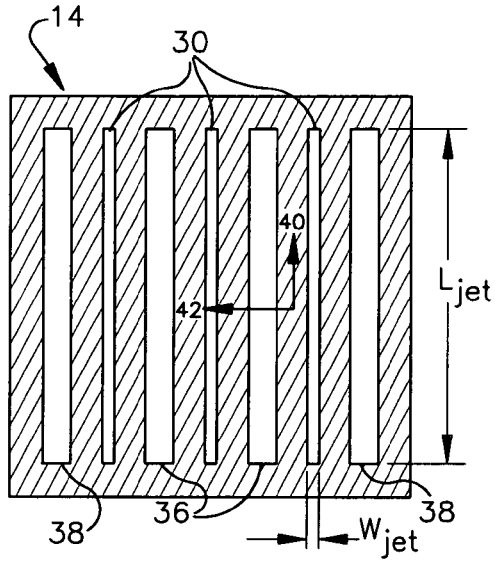
FIG. 3 is a bottom view of the manifold of the cooling device of FIG. 1.

Turning now to FIGS. 2 and 3, details of the interior configuration of the cooling device 10 are discussed. The manifold 14 may include a plenum 28 that is in communication with, and supplies cooling fluid to, multiple fluid inlet slots 30 that allow pressurized fluid to be introduced into an enclosed volume or chamber 32, directed at a major surface 34 of the heat source 12. The plenum 28 may be sized and positioned so as to achieve substantially the same rate of flow in each of the inlet slots 30.

Between adjacent pairs of the fluid inlet slots 30, the manifold 14 has fluid exit ports 36. In addition, the manifold 14 may have side fluid exit ports 38 distal from the outermost of the fluid inlet slots 30. The cooling fluid enters the chamber 32 through the fluid inlet slots 30 and impinges on the major surface 34 of the heat source 12. The fluid flow then turns and exits the chamber 32 through the fluid exit ports 36 and 38.

The manifold 14 may be made of any of a variety of suitable materials, such as stainless steel, aluminum, or polycarbonate. The side walls 16 may also be made of stainless steel, for example. Alternatively, the side walls 16 may be of a structurally strong, low thermal conductivity material, for example such as NEMA Grade G-10 glass epoxy laminate sheet.

As shown in FIG. 3, the inlet slots 30 and the exit ports 36 and 38 are separated from one another in a first direction 42. In addition, the inlet slots 30 and the exit ports 36 and 38 may be elongated in a second direction 40. The inlet slots 30 and the fluid exit ports 36 and 38 may for example be substantially rectangular in shape. The inlet slots 30 and the fluid exit ports 36 and 38 may have an aspect ratio, of distance in the second direction 40, relative to distance in a first direction 42 that is perpendicular to the second direction 40, of equal to or greater than one. That is, a length $L_{jet}$ of the inlet slot 30 may be equal to or greater than a width $W_{jet}$ of the inlet slot 30. Alternatively, the length $L_{jet}$ may be at least about twice that of the width $W_{jet}$. As a further alternative, the length $L_{jet}$ may be at least five times as large as the width $W_{jet}$. The length-to-width aspect ration may be even higher, such as 10:1, 20:1, 30:1, 50:1, or even higher than 50:1. The inlet slots 30 and the exit ports 36 and 38 may be substantially rectangular, although for durability and ease of manufacture the slots 30 and the exit ports 36 and 38 may have rounded corners, for example. It will be appreciated that the inlet slots 30 and the exit ports 36 and 38 may have other suitable elongated shapes.

There also may be a variety of values of the ratio between $H_{jet}$ (FIG. 2), the distance between the manifold 14 and the surface to be cooled 12, and the inlet slot width $W_{jet}$. The ratio of $H_{jet}$ to $W_{jet}$ may be greater than about 1, and may be greater than about 3. The ratio of $H_{jet}$ to $W_{jet}$ may be even higher, for example being greater than about 5, greater than about 10, or greater than about 20.

The inlet slots 30 may all be substantially parallel to one another. In addition, the exit ports 36 and 38 may also be substantially parallel to the inlet slots 30. The interior fluid exit ports 36 may each be placed substantially evenly between an adjacent pair of the fluid inlet slots 30, offset substantially the same distance from each of the inlet slots 30. The outer fluid inlet slots 38 may be placed offset from the adjacent fluid inlet slots 30 approximately the same distance that the fluid exit ports 36 are between the fluid inlet slots 30. As best seen in FIG. 3, the outer fluid exit ports 38 may have approximately half the width of the inner fluid exit ports 36. This is because the inner fluid exit ports 36 each receive approximately half the flow from a pair of adjacent fluid inlet slots 30, while the outer fluid exit ports 38 receive approximately half the flow from only one of the fluid inlet slots 30.

The inlet slots 30 may be narrower in width than the fluid exit ports 36 and 38. Having the inlet slots 30 narrower than the exit ports 36 and 38 may be desirable when some boiling occurs within the chamber 32, to thereby accommodate the increased volume rate of flow due to vaporization of some of the cooling fluid. The ratio of exit port width to inlet slot width may range from about 1 to 10, although it will be appreciated that other ratios may be used. More specifically, the ratio may be from about 1 to 5, and may be about 3.

The fluid inlet slots 30 and the fluid exit ports 36 and 38 may be located within the manifold 14 so as to provide a relatively smooth flow path within the enclosed volume or chamber 32. Referring to the fluid flow path streamlines 50 shown in FIG. 2, fluid flow out from the fluid inlet slots 30 may impinge on the major surface 34 of the heat source 12. The fluid may then make an approximately 180° turn, and exit the enclosed volume 32 through the fluid exit ports 36 and 38. Heat is transferred to the fluid from the heat source 12, and is carried away by the fluid. The flow of the fluid of each of the inlet slots 30 may be substantially confined to respective fluid flow cells 52 within the enclosed volume 32. This is not to say that fluid flow from the inlet slots 30 do not mix with one another, since some intermixing of fluids from different fluid inlet slots 30 may be expected.

The rectangular or otherwise elongated fluid inlet slots 30, and the similarly-elongated exit ports 36 and 38, provide a high degree of cooling uniformity in the transverse direction, the second direction 40. In addition, the placement of the fluid exit ports 36 and 38 substantially parallel to and interspersed with the fluid inlet slots 30 allows turning of the flow in a small space, inhibiting growth of thermal boundary layers. This allows a high degree of cooling uniformity in the streamwise direction, the first direction 42.

The slot jet cooling device 10 may utilize either single-phase or two-phase heat transfer. In a single-phase mode, subcooled liquid enters the enclosed volume 32 from the fluid inlet slots 30, is heated but still remains a liquid, and exits through the fluid exit ports 36 and 38. In two-phase mode operation, subcooled or saturated liquid is introduced into the enclosed volume 32 through the inlet slots 30. Upon impinging on the major surface 34 of the heat source 12 the impinging liquid undergoes a phase change, for example, via nucleate or another type of boiling. A single-phase or two-phase mixture then exits the enclosed volume 32 via the fluid exit ports 36 and 38. Vapor that exits through the fluid exit ports 36 and 38 may be condensed elsewhere in the flow loop that the slot jet cooling device 10 forms a part of. Although the two modes of operation just described are the most likely modes to achieve high levels of heat transfer, and thus high levels of cooling, it will be appreciated that the cooling device 10 may be operable in other modes, for example, involving gas flow, film boiling, or introduction of a two-phase mixture through the inlet slots 30.

Figure 4:
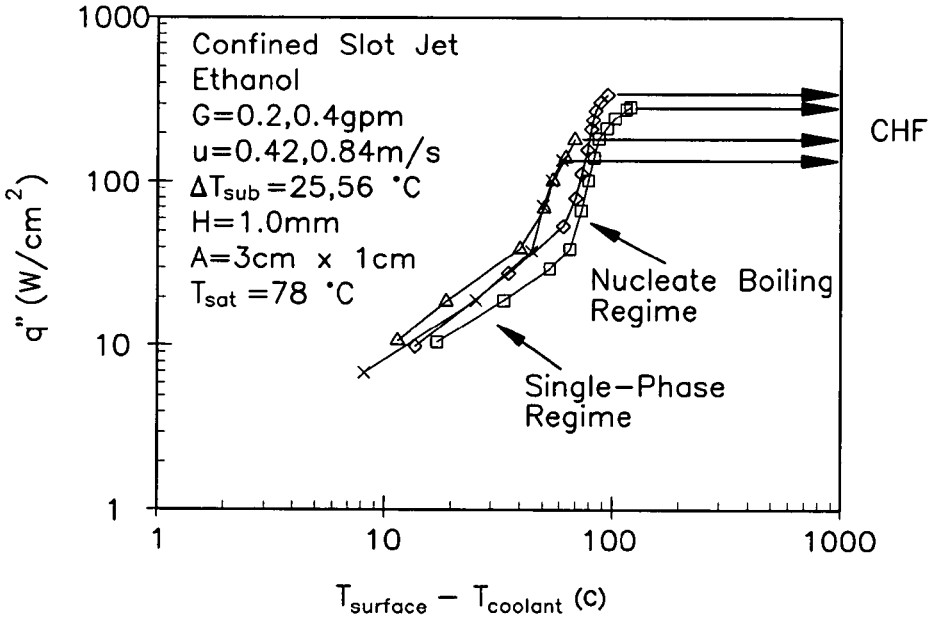
FIG. 4 is a graph showing heat flux as a function of temperature difference for one embodiment of the cooling device of FIG. 1.

The cooling device 10 may be utilized with a large variety of suitable fluids. Examples of suitable fluids include fluorocarbons, alcohols, water, and ammonia. An embodiment of the cooling device 10 has been demonstrated to dissipate more than 100 $W/cm^2$ using fluorocarbons and more than 300 $W/cm^2$ using ethyl alcohol, over a heated surface area of 3 $cm^2$, with a temperature uniformity of ±1° C. FIG. 4 shows a plot of heat flux as a function of a temperature difference between the temperature of the major surface 34 of a heat source 12, and the inlet temperature of the bulk cooling fluid. Heat flux plot is shown for a cooling device having a surface area of 3 $cm^2$, a height of the enclosed volume 32 of 1 mm, and using ethyl alcohol as the cooling fluid. FIG. 4 shows the heat transfer performance of the slot jet cooler in both single-phase and nucleate boiling regimes. FIG. 4 shows a critical heat flux (CHF) at which nucleate boiling transitions to film boiling.

It will be appreciated that the manifold 14 may have any of a large variety of suitable configurations. For example, there may be a greater or lesser number of inlet slots and exit ports, than is shown in the illustrated embodiment. Additionally, if the plenum 28 is included in the manifold 14, it may be positioned above or to the side of the inlet slots 30. It will also be appreciated that fluid may be pumped into and out of the manifold 14 in any of a variety of suitable directions and/or configurations. For example, the fluid may be introduced into the inlet slots 30 from the top of the cooling device 10, and drawn out from the exit ports 36 and 38 through a side of the manifold 14. Alternatively, the cooling fluid may be introduced into the manifold 14 on one side of the manifold 14 and drawn out from the fluid exit ports 36 and 38 on a different side of the manifold. It will be appreciated that there are a variety of other possible configurations.

Figure 5:
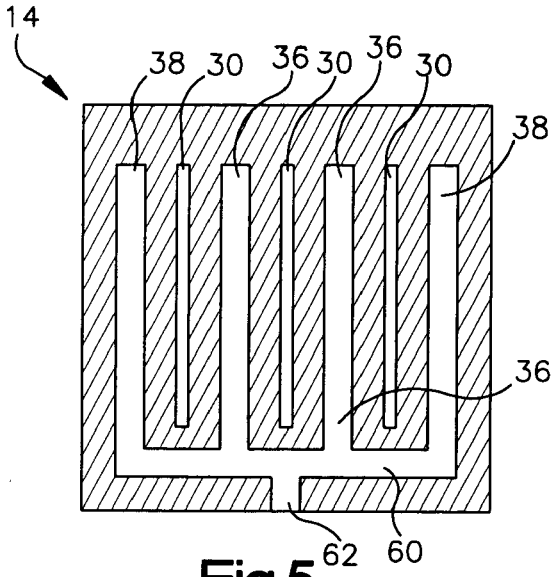
FIG. 5 is a bottom sectional view of the manifold of the cooling device of FIG. 1.
Figure 6:
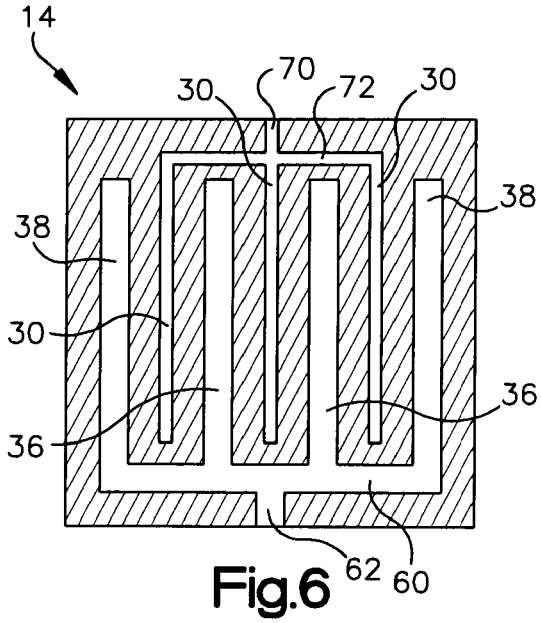
FIG. 6 is a bottom sectional view of another embodiment manifold for a cooling device in accordance with the present invention.

FIGS. 5 and 6 illustrate two configurations of the manifold 14, showing a pair of possible configurations. In FIG. 5 the cooling fluid is introduced from above the manifold 14 directly into the inlet slots 30. A channel 60 connects the fluid exit ports 36 and 38 to a fluid exit 62 along a side of the manifold 14. FIG. 6 illustrates a side-side configuration for introducing and removing fluid from the manifold 14. Fluid enters through an entry port 70, and proceeds through a channel 72 to the inlet slots 30. The fluid inlet 70 is on one side of the manifold 14, on a side of the manifold 14 opposite from the fluid outlet channel 60 and fluid outlet 62, which may be similar to that shown in FIG. 5. It will be appreciated that other configurations are possible, such as where the cooling fluid enters the manifold by a side channel, and exits through the top of the manifold.

Figure 7:
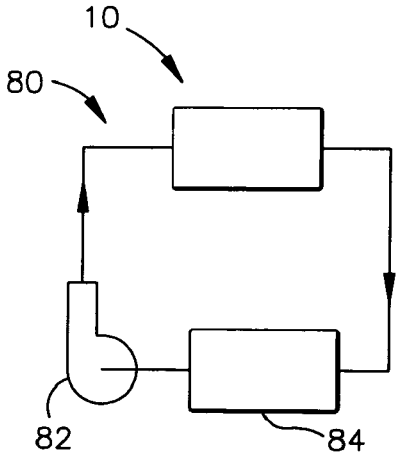
FIG. 7 is a schematic diagram showing the cooling device in accordance with the present invention, as part of a flow loop.

With reference now to FIG. 7, the cooling device or slot jet cooler 10 may be part of a flow loop 80. Cooling fluid may be pumped through the flow loop by a suitable pump 82, with the outlet of the pump 82 coupled to the fluid inlet of the manifold 14 of the cooling device 10. After flow circulates through the cooling device 10, and in particular through the enclosed volume or chamber 32 of the cooling device 10, flow exits the cooling device or slot jet cooler 10 and proceeds through the flow loop 80 to a heat exchanger or condenser 84, which may be used to vent or otherwise expel heat to the environment or another cold source. The heat exchanger 84 may have any of a variety of suitable configurations, for example, involving a serpentine flow path, fins, or forced convection, such as from a cooling fan. It will be appreciated that the flow loop 80 illustrated in FIG. 7 is but one of a wide variety of possible configurations for providing cooling fluid to the slot jet cooler 10 and for removing heat from the cooling fluid provided to the slot jet cooler 10.

The slot jet cooling device 10 disclosed herein offers significant potential advantages relative to other devices used in the past, such as circular jets and spray cooling. The cooling device 10 may provide high heat transfer rates in a small size. In addition, the heat transfer over the exposed portion of the heated surface 12 may be highly uniform, especially when the slot jet cooler operates in a nucleate boiling regime. Although the cooling device 10 offers the potential of high heat transfer rates in a small size, it will be appreciated that the cooling device 10 may be scalable to cool much larger areas.

In one example embodiment, the inlet slots 30 have a length of 10 mm (0.394 inches) and a width of 1 mm (0.039 inches). The exit slots 36 and 38 have the same length, with the exit slots 36 having a width of 3 mm (0.118 inches) and the exit slots 38 having a width of 1.5 mm (0.059 inches). The centerline-to-centerline spacing of the inlet slots 30 and the exit slots 36 is 5 mm (0.197 inches).

Applications for the cooling device 10 include computers, avionics, thermal electric devices, high-current switching devices, heat-producing devices in spacecraft, power supplies, cellular phone stations, compact pressurized water reactors, fusion reactor blankets, particle accelerators, X-ray devices, radar systems, lasers, turbine blades, fuel cells, miniature evaporators and boilers, rocket nozzles, and microwave devices.

Figure 8:
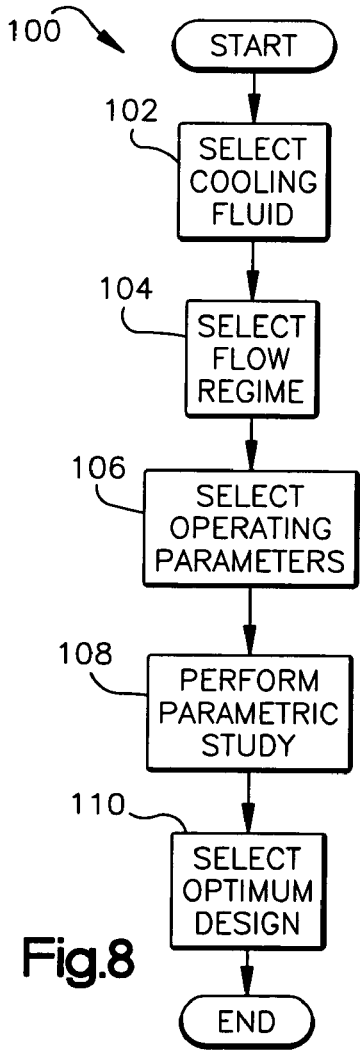
FIG. 8 is a high-level flow chart illustrating steps in a method according to the present invention of the designing a cooling device.

With reference now to FIG. 8, a method 100 for designing the slot jet cooler 10 is described. The method 100 involves selecting a design giving desired heat flux and operating temperature conditions. The method 100 starts in step 102 with selection of a suitable cooling fluid (coolant). Then in step 104, a desired operating regime, such as single-phase flow or nucleate boiling, is selected. In step 106 various operating parameters, such as maximum allowable pressure drop, maximum flow rate, and coolant inlet temperature are selected. These operating parameters may be selected so as to conform with the flow and heat transfer available from the flow loop 80.

In step 108, a parametric study is performed. A parametric study may involve calculation of parameters such as heat transfer rate, pressure drop, and critical heat flux, for a range of geometries (length, width, and/or shape) of the inlet slots 30. The following equations have been found suitable for use in such a parametric study:

$$\frac{\overline{Nu}_L}{Pr_f^{1/3}} = 3.060\,\mathrm{Re}^{0.50} + 0.118\,\mathrm{Re}^{0.694}\left(\frac{L-W}{W}\right)^{0.694} \tag{1}$$

$$\text{where } \overline{Nu}_L = \frac{\overline{h}_L L}{k_f} \text{ and } \mathrm{Re} = \frac{U(2W)}{\nu_f}$$

$$q_s'' = \mu_f h_{fg}\left[\frac{g(\rho_f-\rho_g)}{\sigma_f}\right]^{1/2}\left[\frac{c_{pf}\Delta T_e}{C_{sf} h_{fg} Pr_f^n}\right]^3 \tag{2}$$

$$\frac{q_{CHF}''}{\rho_g U h_{fg}} = 0.0919\left[\frac{\rho_f}{\rho_g}\right]^{2/3}\left[1+\frac{c_{pf}\Delta T_{sub}}{h_{fg}}\right]^{1/3}\left[1+0.034\frac{\rho_f c_{pf}\Delta T_{sub}}{\rho_g h_{fg}}\right]^{2/3} \tag{3}$$

$$\left[\frac{\sigma}{\rho_f U^2(L-W)}\right]^{0.157}\left[\frac{W}{L-W}\right]^{0.331}$$

$$\Delta p = \left(f\frac{L_{eq}}{D_h} + \sum K\right)\frac{\rho_f V^2}{2} \tag{4}$$

Equation (1) provides heat flux for single-phase heat transfer, Equation (2) provides heat flux for nucleate boiling, Equation (3) provides the critical heat flux, and Equation (4) provides pressure drop. In the above equation, $C_{sf}$ is an empirical constant associated with nucleate boiling, $D_h$ is hydraulic diameter, f is a friction factor, K is a loss coefficient, L is the length of the heater surface corresponding to one inlet slot, $L_{eq}$ is the equivalent length, n is an empirical constant associated with nucleate boiling, U is the inlet slot velocity, and W is the inlet slot width.

Finally, in step 110, an optimum design is selected based on the results of the parametric study. The optimum design may include the dimensions and shape of the inlet slots 30, the number and spacing of the inlet slots 30, and the dimensions and placement of the fluid exit ports 36 and 38.

Figure 9:
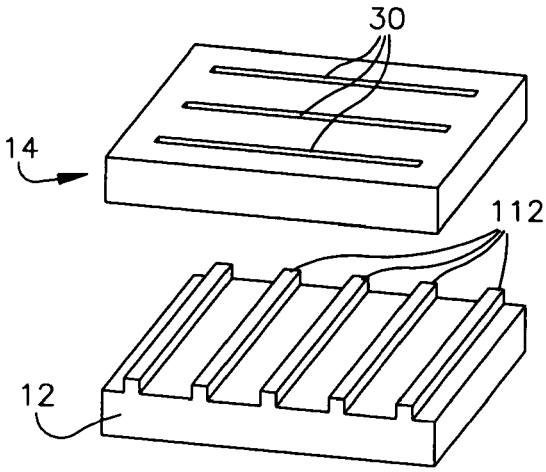
FIG. 9 is an oblique view of parts of another embodiment of a cooling device cooling a cooled surface in accordance with the present invention.

FIG. 9 shows an additional embodiment cooler 10, in which the cooled surface or heat source 12 has a number of fins or extended surfaces 112 thereupon. The fins 112 may be substantially perpendicular to the inlet slots 30 and the manifold 14. It will be appreciated that the fins 112 may increase the heat transfer from the cooled surface 12 to the cooling fluid, without significantly altering the turning flow of the cooling fluid.

Figure 10:
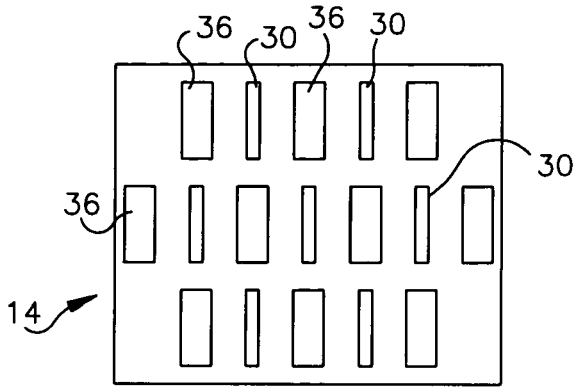
FIG. 10 is a bottom view of yet another embodiment manifold of a cooling device in accordance with the present invention.

FIG. 10 shows the manifold 14 of another additional embodiment of the cooler 10. The manifold 14 has inlet slots 30 and exit ports 36 that alternate in a pair of substantially perpendicular directions. A given inlet slot 30 may be between a pair of the exit ports 36 on both sides, as well as being between another pair of the exit ports 36 on both ends.

Figure 11:
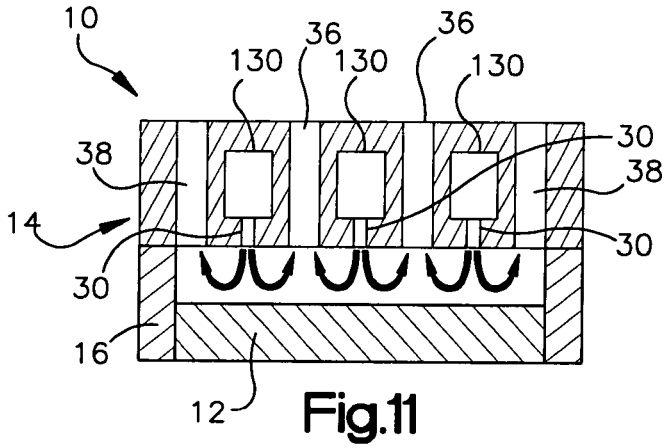
FIG. 11 is a side sectional view of a further embodiment of a slot jet cooling device in accordance with the present invention.
Figure 12:
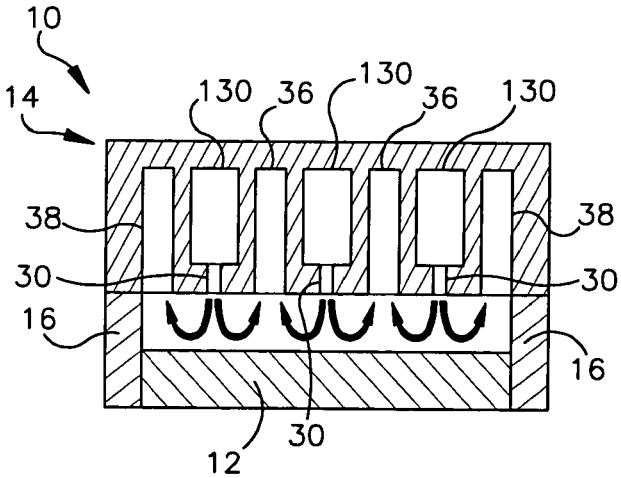
FIG. 12 is a side sectional view of a still further embodiment of a slot jet cooling device in accordance with the present invention.

FIGS. 11 and 12 show further embodiments of the cooler 10, with different configurations of the manifold 14. FIG. 11 illustrates a manifold configuration in which the inlet slots 30 are in communication with channels 130, and the exit ports 36 and 38 pass through the manifold 14 from bottom to top. FIG. 12 illustrates another manifold configuration, one in which the exit ports 36 and 38 do not pass through the manifold 14 from bottom to top, but rather form channels that may exit the manifold 14 from a side of the manifold 14.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A cooling device for cooling a cooled surface, the device comprising:
- a manifold; and
- one or more side walls;
- wherein the manifold, the side walls, and the cooled surface together define an enclosed volume;
- wherein the manifold and the cooled surface are on opposite sides of the enclosed volume;
- wherein the manifold has plural inlet slots therein for directing fluid at the cooled surface;
- wherein the inlet slots are substantially parallel to each other; and
- wherein the inlet slots have a substantially rectangular cross section shape.

2. The device of claim 1,
- wherein the manifold also has plural fluid exit ports therein; and
- wherein each pair of adjacent inlet slots has at least one of the exit ports therebetween.

3. The device of claim 2, wherein the exit ports are substantially parallel to the inlet slots.

4. The device of claim 3, wherein each of the inlet slots is substantially evenly spaced between a pair of adjacent exit ports.

5. A cooling device for cooling a cooled surface, the device comprising:
- a manifold; and
- one or more side walls;
- wherein the manifold, the side walls, and the cooled surface together define an enclosed volume;
- wherein the manifold and the cooled surface are on opposite sides of the enclosed volume;
- wherein the manifold has plural inlet slots therein for directing fluid at the cooled surface;
- wherein the inlet slots are substantially parallel to each other;
- wherein the manifold also has plural fluid exit ports therein;
- wherein each pair of adjacent inlet slots has at least one of the exit ports therebetween;
- wherein the exit ports are substantially parallel to the inlet slots; and
- wherein the exit ports include a pair of end exit ports on opposite ends of the enclosed volume.

6. The device of claim 5, wherein the end exit ports each have a width approximately half a width of the other exit ports.

7. A cooling device for cooling a cooled surface, the device comprising:
- a manifold; and
- one or more side walls;
- wherein the manifold, the side walls, and the cooled surface together define an enclosed volume;
- wherein the manifold and the cooled surface are on opposite sides of the enclosed volume;
- wherein the manifold has plural inlet slots therein for directing fluid at the cooled surface;
- wherein the inlet slots are substantially parallel to each other;
- wherein the inlet slots are separated from one another in a first direction; and
- wherein the inlet slots have a cross section shape with a length in a second direction that is perpendicular to the first direction, that is greater than a width in the first direction.

8. The device of claim 7, wherein the length is at least about 5 times the width.

9. The device of claim 8, wherein the length is at least about 20 times the width.

10. The device of claim 7,
- wherein the manifold also has plural fluid exit ports therein; and
- wherein each pair of adjacent inlet slots has at least one of the exit ports therebetween.

11. The device of claim 10,
- wherein the exit ports are substantially parallel to the inlet slots; and
- wherein each of the inlet slots is substantially evenly spaced between a pair of adjacent exit ports.

12. A cooling device for cooling a cooled surface, the device comprising:
- a manifold; and
- one or more side walls;
- wherein the manifold, the side walls, and the cooled surface together define an enclosed volume;
- wherein the manifold and the cooled surface are on opposite sides of the enclosed volume;

wherein the manifold has plural inlet slots therein for directing fluid at the cooled surface;

wherein the inlet slots are substantially parallel to each other; and wherein the cooling surface has a substantially flat major surface facing the inlet slots.

13. A cooling device for cooling a cooled surface, the device comprising:

a manifold; and one or more side walls;

wherein the manifold, the side walls, and the cooled surface together define an enclosed volume;

wherein the manifold and the cooled surface are on opposite sides of the enclosed volume;

wherein the manifold has plural inlet slots therein for directing fluid at the cooled surface;

wherein the inlet slots are substantially parallel to each other; and in combination with a pump coupled to manifold to provide a cooling fluid to the inlet slots, and to remove the cooling fluid from the exit ports.

14. A cooling device for cooling a cooled surface, the device comprising:

a manifold; and one or more side walls;

wherein the manifold, the side walls, and the cooled surface together define an enclosed volume;

wherein the manifold and the cooled surface are on opposite sides of the enclosed volume;

wherein the manifold has plural inlet slots therein for directing fluid at the cooled surface;

wherein the inlet slots are substantially parallel to each other; and wherein the cooled surface has fins thereupon that are substantially perpendicular to the inlet slots.

15. A cooling device for cooling a cooled surface, the device comprising:

a manifold; and one or more side walls;

wherein the manifold, the side walls, and the cooled surface together define an enclosed volume;

wherein the manifold and the cooled surface are on opposite sides of the enclosed volume;

wherein the manifold has plural inlet slots therein for directing fluid at the cooled surface;

wherein the inlet slots are substantially parallel to each other; and wherein the plural inlet slots are a first set of inlet slots that are parallel to one another in a first direction;

further comprising a second set of inlet slots that are offset from the first set of inlet slots in a second direction that is substantially perpendicular to the first direction.

16. A method of cooling a cooled surface, comprising:

directing a cooling fluid into an enclosed volume through a plurality of substantially-parallel inlet slots toward a major surface of the cooled surface;

transferring heat from the cooled surface to the cooling fluid; and removing the cooling fluid from the enclosed volume through exit ports, wherein adjacent pairs of the inlet slots have respective substantially-parallel exit ports therebetween;

wherein the directing includes directing a subcooled liquid toward the major surface; and wherein the transferring heat includes single-phase heat transfer from the cooled surface to the subcooled liquid.

17. A method of cooling a cooled surface, comprising:

directing a cooling fluid into an enclosed volume through a plurality of substantially-parallel inlet slots toward a major surface of the cooled surface;

transferring heat from the cooled surface to the cooling fluid; and removing the cooling fluid from the enclosed volume through exit ports, wherein adjacent pairs of the inlet slots have respective substantially-parallel exit ports therebetween;

wherein the directing includes directing a subcooled or saturated liquid toward the major surface; and wherein the transferring heat includes boiling heat transfer from the cooled surface to the liquid.

18. A method of cooling a cooled surface, comprising:

directing a cooling fluid into an enclosed volume through a plurality of substantially-parallel inlet slots toward a major surface of the cooled surface;

transferring heat from the cooled surface to the cooling fluid; and removing the cooling fluid from the enclosed volume through exit ports, wherein adjacent pairs of the inlet slots have respective substantially-parallel exit ports therebetween;

wherein the inlet slots are separated from one another in a first direction; and wherein the inlet slots have a cross section shape with a length in a second direction that is perpendicular to the first direction, that is greater than a width in the first direction.

19. The method of claim 18, wherein the length is at least about 5 times the width.

20. The method of claim 19, wherein the length is at least about 20 times the width.

21. The method of claim 19, wherein the exit ports also have a length that is at least about 5 times a width of exit port.

22. The method of claim 18, wherein the inlet slots and the exit ports are in a manifold.

23. A method of designing a slot jet cooling device, the method comprising:

selecting a cooling fluid;

selecting a desired operating regime;

performing a parametric study calculating parameters for a variety of geometries; and selecting a cooling device design based on results of the parametric study.

* * * * *